US005083934A

United States Patent [19]

Kawaguchi

[11] Patent Number: 5,083,934

[45] Date of Patent: Jan. 28, 1992

[54] ELECTRICAL CONNECTOR SYSTEM

[76] Inventor: Akira Kawaguchi, 624-9, Oaza-Kishi, Musashimurayama-shi, Tokyo, Japan

[21] Appl. No.: 530,383

[22] Filed: May 30, 1990

[30] Foreign Application Priority Data

May 30, 1989 [JP] Japan ..... 1-137177

[51] Int. Cl.[5] ..... H01R 4/24

[52] U.S. Cl. ..... 439/394; 439/582; 439/341

[58] Field of Search ..... 439/387, 443, 79, 851, 439/856, 861, 862, 259, 578–585, 607, 609, 610, 670, 676, 341, 394

[56] References Cited

U.S. PATENT DOCUMENTS

| | | | |
|---|---|---|---|
| 3,287,686 | 11/1966 | Ruehlemann | 439/79 |
| 3,694,793 | 9/1972 | Concelman | 439/675 |
| 4,538,871 | 9/1985 | Li | 439/342 |
| 4,701,001 | 10/1987 | Verhoeven | 439/394 |
| 4,708,414 | 11/1987 | Lam | 439/394 |
| 4,778,407 | 10/1988 | Myers | 439/443 |
| 4,846,719 | 7/1989 | Iwashita | 439/668 |

*Primary Examiner*—David L. Pirlot

[57] ABSTRACT

An electrical connector system (160) formed from mating a plug connector (60) into a receptacle connector (10). More particularly the connector system (160) enjoys a low profile because contacts (14,16) in the receptacle connector (10) which receive the leads (104,116) from contacts (64,66) in the plug connector (60) are parallel to and adjacent the floor (24) of the receptacle connector (10).

8 Claims, 5 Drawing Sheets

ELECTRICAL CONNECTOR SYSTEM

FIELD OF THE INVENTION

The present invention relates to two piece electrical connectors comprising a plug connector and a receptacle connector which are mated together to electrically connect the contacts in the respective connectors.

BACKGROUND OF THE INVENTION

It is known from Japanese Patent Application No. 3863/89 to stack a plug connector on top of a receptacle connector with contact leads depending from the former entering into openings in the latter to electrically engage upright contacts disposed therein. Whereas this arrangement is engineeringly acceptable, there is an increasing need for miniaturizing such connector systems while maintaining the same function and performances. More particularly there is a strong need for such connector systems to have as low a profile as possible. Accordingly, it is now proposed to provide a connector system which minimizes the overall height of the plug and receptacle connectors when mated together.

SUMMARY OF THE INVENTION

An electrical connector system is provided wherein the receptacle connector includes contacts having slotted termination sections positioned parallel and adjacent to the floor of the plug connector-receiving cavity in the receptacle connector to provide a low profile.

Figure 1A:
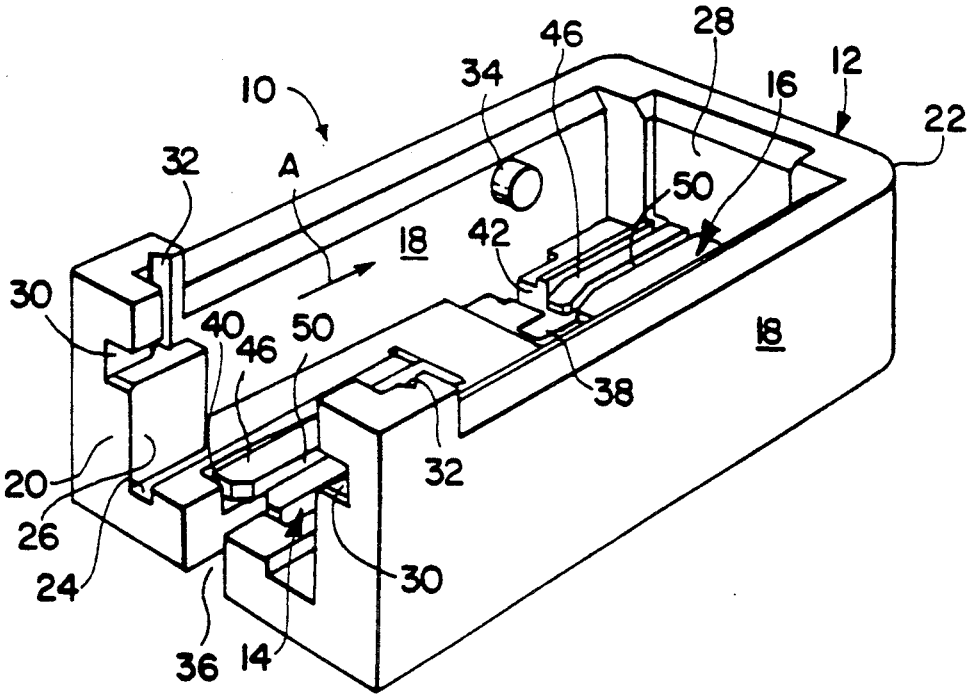
FIGS. 1A, 1B and 1C are respectively a perspective view, a plan view and a sectioned view taken along lines 1C—1C in FIG. 1B of the receptacle connector of the present invention.

First endwall 20 includes opening 26 which communicates with outwardly open cavity 28 defined by walls 18,20,22 and floor 24. Grooves 30 are provided on each side of opening 26 and communicate with vertical, triangular grooves 32. Further inwardly, pins 34 project into cavity 28 from both sidewalls 18.

Aligned slots 36,38 extend through floor 24 with slot 36 beginning at endwall 20 and extending inwardly through the center of first recess 40. Slot 38 begins on the other side of recess 40 and extends through the center of second recess 42. Passages 44 extending through floor 24 are provided at the ends 40*a* and 42*a* of recesses 40,42 respectively (FIG. 1C).

Contacts 14,16 include termination sections 46 and pins or leads 48 (FIG. 1C) which are bent at right angles to sections 46. Each section 46 includes slot 50.

Figure 1B:
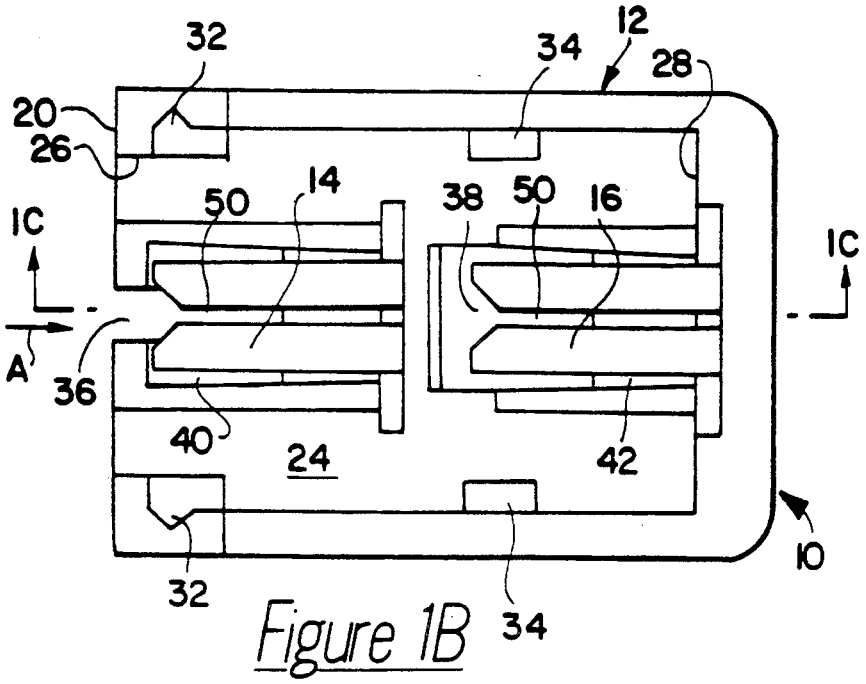
Figure 1C:
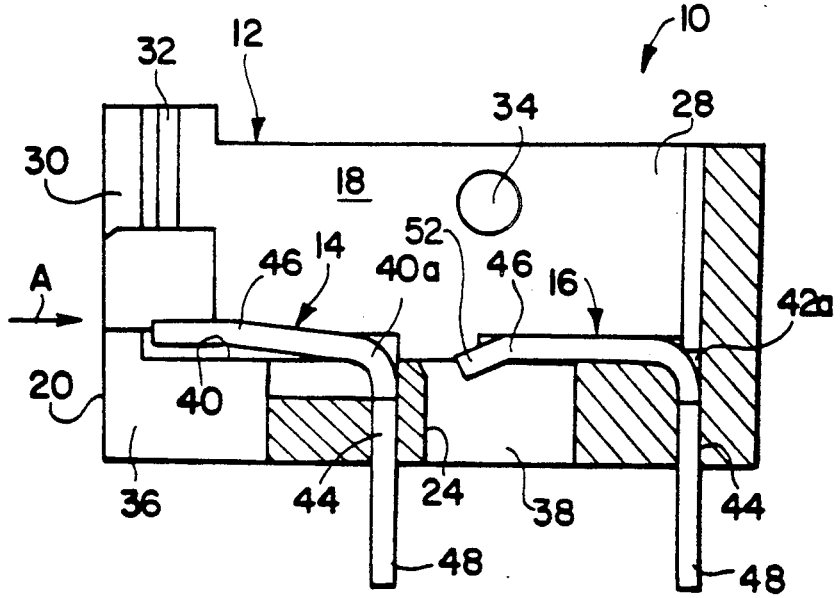

Termination sections 46 of contacts 14,16 are positioned in respective recesses 40,42 and leads 48 extend through passages 44 as shown in FIGS. 1C. Free end 52 of termination section 46 of contact 16 may be bent into slot 38 as shown if desired.

Housing 12 is preferably molded from a suitable plastics material. Contacts 14,16 are stamped and formed from a metal such as beryllium copper.

As can be discerned from the foregoing description, termination sections 46 of contacts 14,16 are parallel to floor 24 as opposed to the upright termination sections of the prior art plug connectors (not shown).

Plug connector 60, shown in FIGS. 2A, 2B, 2C, 4 and 5 include dielectric housing 62, first contact 64 and second contact 66.

Housing 62 includes sidewalls 68, first and second endwalls 70,72 respectively, floor 74, first cavity 76, and second cavity 78. Connector 60 also includes cover 80 which is hinged to second endwall 72 of housing 62.

Each sidewall 68 includes a rectangular member 82 with a triangular projection 84 at one end. Sidewalls 68 are further provided with a downwardly facing shoulder 86 and L-shaped recess 87 having a first portion 87*a* and a second portion 87*b*.

Endwall 70 includes opening 88 which communicates with first cavity 76. Second cavity 78, communicating with first cavity 78 and adjacent second endwall 72, includes transverse slot 90. Passages (not shown) extend through floor 74 from respective cavities 76,78.

Cover 80 includes a rectangular plate 92 from which curved wire pusher 94 projects. First locking levers 96 extended outwardly from each corner of free end 98 and have end portions 100 which project laterally. Second locking levers 102 extend outwardly from respective sides of plate 92 and are provided with openings 102*a*.

Figure 2A:
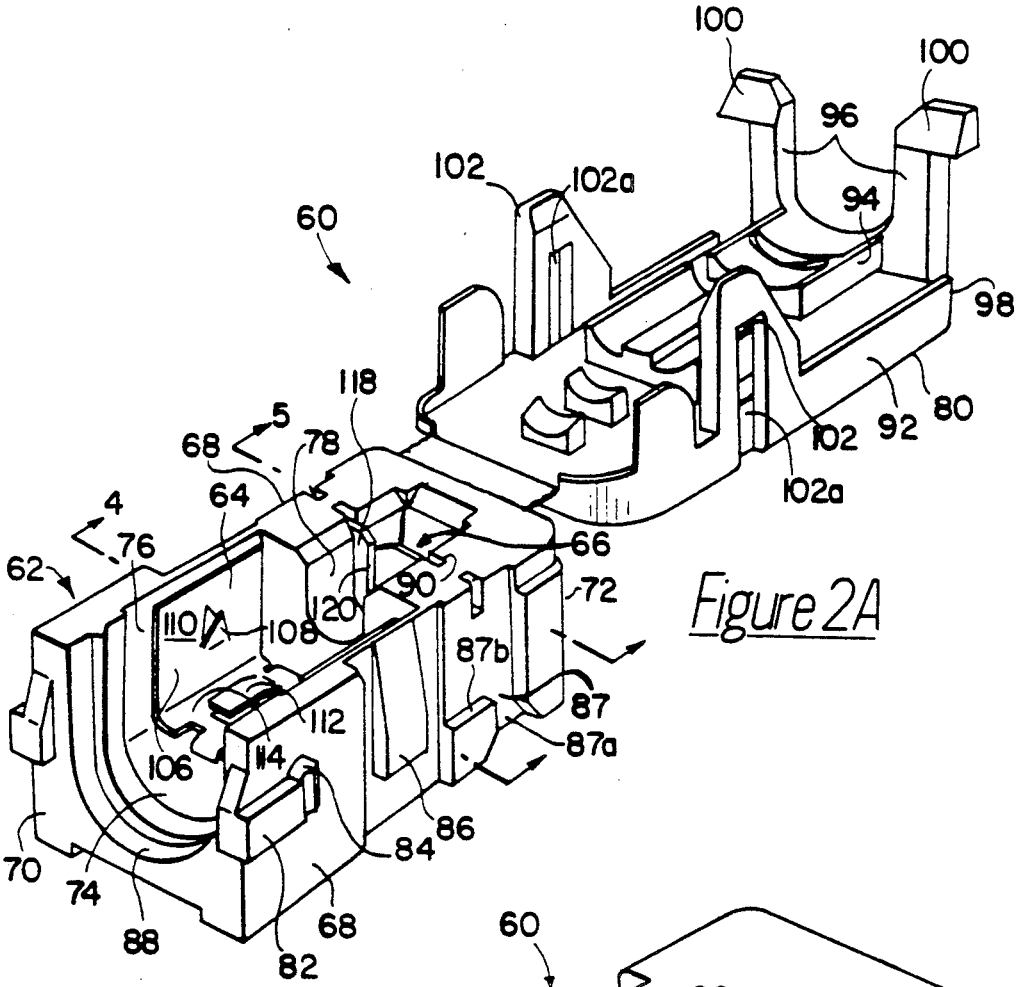
FIGS. 2A, 2B and 2C are respectively a perspective view with the cover open, a perspective view with the cover closed and a side view of the plug connector of the present invention.
Figure 2B:
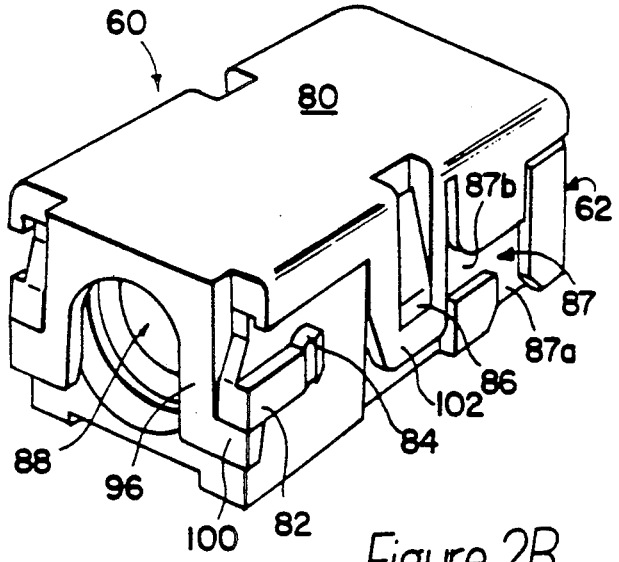
Figure 2C:
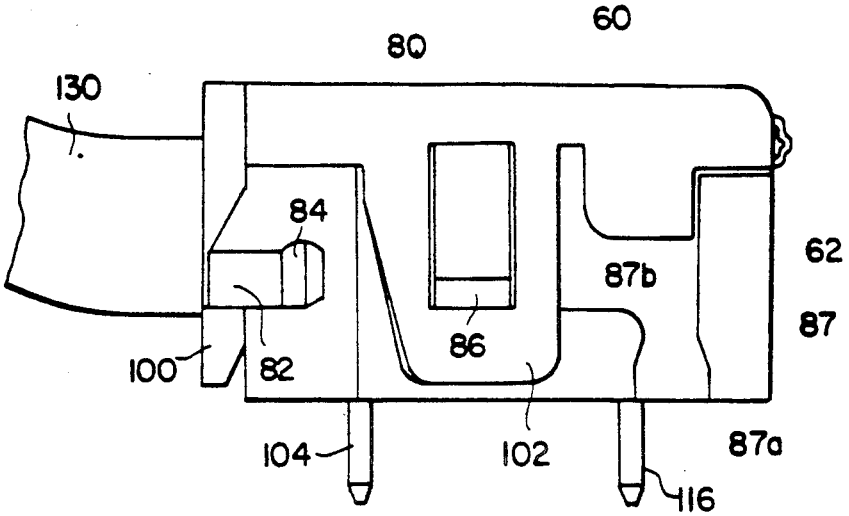

First contact 64 is disposed in first cavity 76 and includes lead 104 (FIG. 2C) and wire receiving channel 106. Channel 106 includes outwardly and obliquely projecting lances 108 on sidewalls 110 and a spring plate 112 struck from floor 114. As shown in FIG. 2C, lead 104 extends outwardly from housing 62.

Second contact 66 is disposed in second cavity 76 with lead 116 extending outwardly from housing 62 (FIG. 2C) and plate 118 in transverse slot 90. Plate 118 includes wire receiving slot 120.

Figure 4:
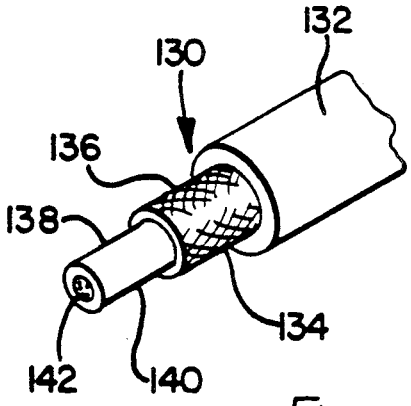
FIG. 4 is a perspective view of a coaxial cable as prepared for being terminated in the plug connector.

In operation, an end of coaxial cable 130 is prepared as shown in FIG. 4. That is, outer insulation 132 is removed to provide a first portion 134 having ground braid 136 exposed. A second portion 138 is provided by removing braid 136 to expose inner insulation 140 which covers siqnal wire 142.

Figure 3:
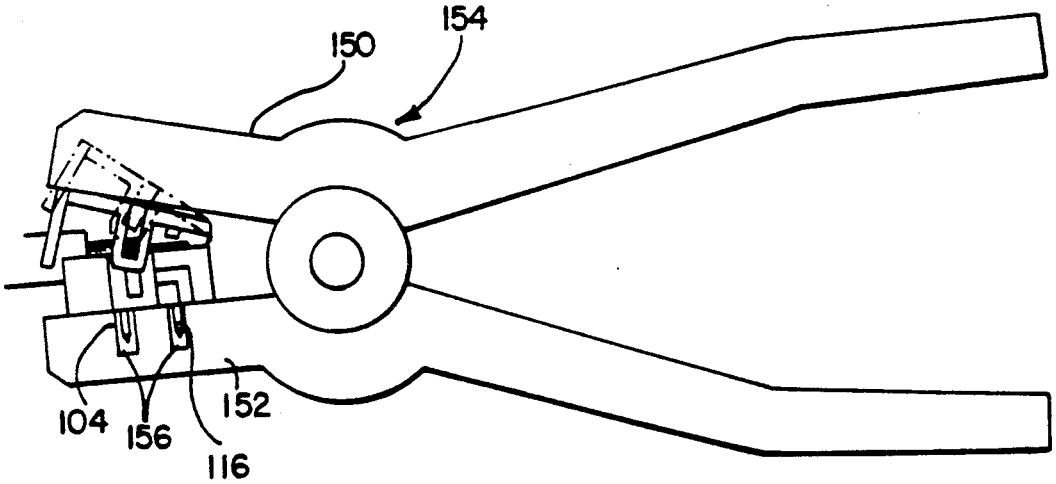
FIG. 3 is a view illustrating the closing of the plug connector with one example of a tool for doing so.

Cable 130 is placed into housing 62 with first portion 134 in channel 106 of first contact 64 and second portion 138 at the top of transverse slot 90. Cover 80 is swung over housing 62 and that assembly is placed between jaws 150,152 of tool 154 shown in FIG. 3. Leads 104,116 are projection by being received in recesses 156 in jaw 152. Upon bringing jaws 150,152 toWard each other, cover 80 is latched onto housing 62 by end portions 100 on first locking levers 96 camming in under rectangular members 82 and shoulders 86 entering openings 102*a*. Simultaneously, wire pusher 94 pushes first portion 134 of cable 130 into channel 106 and second portion 138 into slot 120. Lances 108 pierce braid 136 and the edges of slot 120 cut through inner insulation 140 to electrically contact signal wire 142. FIG. 2C shows connector 60 in the closed position.

Subsequent to terminating cable 130 in connector 60, connector 60 is attached to receptacle connector 10 by first entering cavity 28 from above so that lead 104 enters slot 36 just in front of first contact 14 and lead 116 enters slot 38 just in front of second contact 16. Simultaneously, pins 34 on sidewalls 18 enter recesses 87*a*. At this point, triangular projections 84 on members 82 are in line with but have not entered grooves 30.

Connector 90 is now pushed lengthwise into cavity 28 in the direction of arrow A shown in FIGS. 1A, 1B and 1C. Pins 34 enter recesses 87*b* and rectangular members enter grooves 30. Further, leads 104,116 enter slots 50 in respective contacts 14,16 to make electrical contact therewith.

Figure 5:
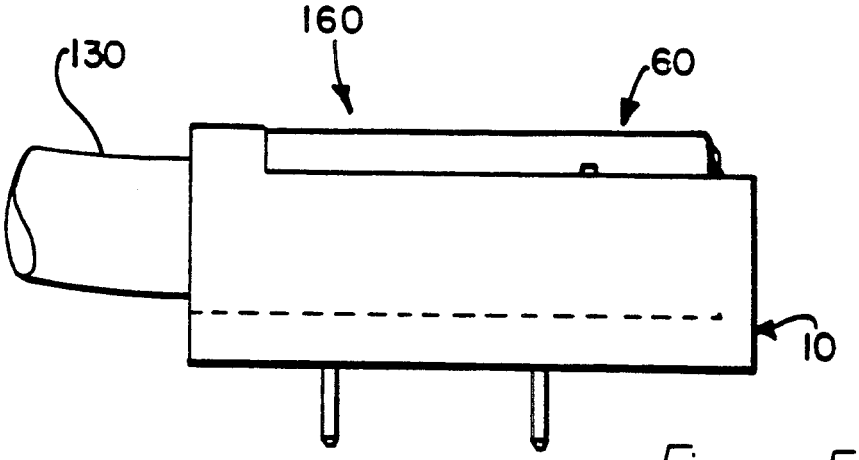
FIG. 5 is a side view of the mated receptacle and plug connectors forming the electrical connector system of the present invention. cl DESCRIPTION OF THE INVENTION Receptacle connector 10 shown in FIGS. 1A, 1B and 1C includes a block-like dielectric housing 12 and first and second conductive contacts 14, 16 respectively. Housing 12 is defined by sidewalls 18, first endwall 20, second endwall 22 and a floor 24.

The mating of connectors 10 and 60 to form the electrical connector system 160 of the present invention is completed when triangular projections 84 on connector 60 enter triangular grooves 32 within cavity 28 of housing 12 of connector 10. Further, the sound of projections 84 entering grooves 32 is a positive sign that connectors 10,60 are mated together, mechanically and electrically. FIG. 5 shows system 160.

I claim:

1. An electrical connector system, comprising:

a receptacle connector comprising a dielectric first housing and first and second conductive contacts, said housing having a cavity opening upwardly, an opening in said cavity in one endwall and grooves in said one endwall on respective sides of and opening to said opening, said first and second contacts having a slotted termination section at one end, said contacts being positioned in tandem in said housing with said termination section being parallel with a floor of said cavity; and a plug connector comprising a dielectric second housing and third and fourth conductive contacts, said housing having a cavity and members on outside surfaces of respective sidewalls for being slidingly received in said grooves as said plug connector is slid into said first housing cavity and said third and fourth contacts each having means for terminating respectively a grounding braid and a signal wire of a coaxial cable, and further having leads, said third and fourth contacts being disposed in said cavity in tandem with said leads extending outwardly from said housing;

said electrical connector formed by first partly inserting said plug connector into said cavity of said receptacle connector and thereafter sliding said plug connector fully into said cavity with said leads on said third and fourth contacts received in respective said slotted termination sections for electrical connection with said first and second contacts.

2. The electrical connector system of claim 1 wherein pins on respective sidewalls of said first housing project into said cavity thereof are received in L-shaped recesses provided on outside surfaces of respective sidewalls of said second housing as said plug connector is insertably and slidably received in said receptacle connector.

3. The electrical connector system of claim 1 wherein recesses are provided in said floor of said cavity in said first housing for receiving said termination sections.

4. The electrical connector system of claim 3 further including slots in said floor of said cavity, said slots being in registration with said slots in said slotted termination sections and being adapted to receive said leads extending outwardly from said plug connector.

5. An electrical connector, comprising:

a receptacle connector including a first dielectric housing having a cvaity opening upwardly, spaced electrical contacts secured in a bottom section of said housing and having substantially aligned slotted termination sections extending substantially parallel along said bottom section with the slotted termination sections extending toward one end of said first housing;

a plug connector including a dielectric second housing having spaced electrical terminals secured therein and including means for termination to a signal wire and an outer conductor of a coaxial cable, said terminals having leads extending outwardly from said second housing;

first guide means comprising pins on opposing sidewalls of said first housing extending into said cavity and vertical recesses along outside surfaces of sidewalls of said second housing for receiving said pins for guiding vertical movement of said plug connector as said plug connector is mated with said receptacle connector within said cavity thereby aligning said leads with respective slotted termination sections;

second guide means comprising an opening to said cavity in said one end of said first housing, opposing sidewalls forming said opening having grooves, members extending outwardly from outside surfaces of sidewalls of said second housing and being slidably received in said grooves for guiding horizontal movement of said plug connector with respect to said receptacle connector so that said leads are electrically connected with said slotted termination sections; and retaining means on said first and second housings retaining said connectors in a connected position.

6. An electrical connector as claimed in claim 5, wherein said retaining means includes pins on opposing sidewalls of said first housing extending into said cavity, said one end of said first housing having an opening to said cavity with opposing walls of said opening having grooves provided with triangular sections, horizontal recesses along outside surfaces of sidewalls of said second housing in which said pins are received when the plug connector is horizontally moved, members including triangular projections extending outwardly from the outside surfaces of the sidewalls of said second housing and being slidably received in said grooves as said plug connector moves horizontally relative to said receptacle connector with said triangular projections being disposed in said triangular sections.

7. An electrical connector as claimed in claim 5, wherein recesses are provided in said bottom section of said first housing in which said slotted termination sections are disposed.

8. An electrical connector as claimed in claim 5, wherein said bottom section of said first housing includes slots in alignment with said slotted termination sections for receiving the leads extending outwardly from said plug connector.

* * * * *